US007317420B2

(12) United States Patent
Aisenbrey

(10) Patent No.: US 7,317,420 B2
(45) **Date of Patent: *Jan. 8, 2008**

(54) LOW COST OMNI-DIRECTIONAL ANTENNA MANUFACTURED FROM CONDUCTIVE LOADED RESIN-BASED MATERIALS

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 64 days.

This patent is subject to a terminal disclaimer.

(21) Appl. No.: 10/900,964

(22) Filed: Jul. 28, 2004

(65) Prior Publication Data

US 2005/0007290 A1 Jan. 13, 2005

Related U.S. Application Data

(63) Continuation-in-part of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/496,765, filed on Aug. 21, 2003, provisional application No. 60/317,808, filed on Sep. 7, 2001, provisional application No. 60/269,414, filed on Feb. 16, 2001, provisional application No. 60/268,822, filed on Feb. 15, 2001.

(51) Int. Cl.
*H01Q 1/38* (2006.01)

(52) U.S. Cl. ..... 343/700 MS; 343/702; 343/713; 343/873

(58) Field of Classification Search ..... 29/600; 343/700 MS, 702, 793, 873
See application file for complete search history.

(56) References Cited

U.S. PATENT DOCUMENTS 3,916,078 A * 10/1975 Priaroggia ..... 174/10

(Continued)

FOREIGN PATENT DOCUMENTS

GB 2377449 A 7/2001

(Continued)

OTHER PUBLICATIONS

Co-pending U.S. Appl. No. 10/309,429, filed Dec. 4, 2002, "Low Cost Antennas Using Conductive Plastics or Conductive Composites", assigned to the same assignee.

*Primary Examiner*—Trinh Vo Dinh
(74) *Attorney, Agent, or Firm*—Douglas R. Schnabel

(57) ABSTRACT

Omni-directional antenna devices are formed of a conductive loaded resin-based material. The conductive loaded resin-based material comprises micron conductive powder(s), conductive fiber(s), or a combination of conductive powder and conductive fibers in a base resin host. The percentage by weight of the conductive powder(s), conductive fiber(s), or a combination thereof is between about 20% and 50% of the weight of the conductive loaded resin-based material. The micron conductive powders are formed from non-metals, such as carbon, graphite, that may also be metallic plated, or the like, or from metals such as stainless steel, nickel, copper, silver, that may also be metallic plated, or the like, or from a combination of non-metal, plated, or in combination with, metal powders. The micron conductor fibers preferably are of nickel plated carbon fiber, stainless steel fiber, copper fiber, silver fiber, or the like.

24 Claims, 7 Drawing Sheets

U.S. PATENT DOCUMENTS

| | | | | |
|---|---|---|---|---|
| 4,143,377 | A | 3/1979 | Salvat et al. | 343/755 |
| 4,633,265 | A | 12/1986 | Wheeler | 343/797 |
| 5,121,129 | A | 6/1992 | Lee et al. | 343/753 |
| 5,534,880 | A | 7/1996 | Button et al. | 343/774 |
| 5,771,027 | A * | 6/1998 | Marks et al. | 343/912 |
| 6,147,660 | A * | 11/2000 | Elliott | 343/895 |
| 6,147,662 | A * | 11/2000 | Grabau et al. | 343/895 |
| 6,717,550 | B1 | 4/2004 | Aisenbrey | 343/700 MS |
| 6,741,221 | B2 | 5/2004 | Aisenbrey | 343/897 |
| 6,870,516 | B2 * | 3/2005 | Aisenbrey | 343/873 |
| 2003/0184490 | A1 | 10/2003 | Raiman et al. | 343/799 |
| 2005/0078050 | A1 * | 4/2005 | Aisenbrey | 343/895 |
| 2006/0003667 | A1 * | 1/2006 | Aisenbrey | 446/454 |

FOREIGN PATENT DOCUMENTS

| | | | |
|---|---|---|---|
| JP | 200021470 | A * | 1/2000 |

* cited by examiner

LOW COST OMNI-DIRECTIONAL ANTENNA MANUFACTURED FROM CONDUCTIVE LOADED RESIN-BASED MATERIALS

This Patent Application claims priority to the U.S. Provisional Patent Application 60/496,765, filed on Aug. 21, 2003, which is herein incorporated by reference in its entirety.

This Patent Application is a Continuation-in-Part of INT01-002CIP, filed as U.S. patent application Ser. No. 10/309,429, filed on Dec. 4, 2002, now U.S. Pat. No. 6,870,516 also incorporated by reference in its entirety, which is a Continuation-in-Part application filed as U.S. patent application Ser. No. 10/075,778, filed on Feb. 14, 2002, now U.S. Pat. No. 6,741,221 which claimed priority to U.S. Provisional Patent Applications Ser. No. 60/317,808, filed on Sep. 7, 2001, Ser. No. 60/269,414, filed on Feb. 16, 2001, and Ser. No. 60/268,822, filed on Feb. 15, 2001.

BACKGROUND OF THE INVENTION (1) Field of the Invention

This invention relates to antenna devices and, more particularly, to an omni-directional antenna device molded of conductive loaded resin-based materials comprising micron conductive powders, micron conductive fibers, or a combination thereof, homogenized within a base resin when molded. This manufacturing process yields a conductive part or material usable within the EMF or electronic spectrum(s).

(2) Description of the Prior Art

Antennas are essential in any electronics system containing wireless communication links. A wide variety of applications use antennas to implement transmitting and/or receiving functions. Lowering the cost of antenna materials and/or production costs, as well as creating new packaging capabilities, offers significant advantages for any application utilizing and antenna device.

Several prior art inventions relate to omni-directional antenna devices or to antenna devices of conductive resin materials. U.S. Pat. No. 6,741,221, B2 to Aisenbrey teaches low cost antennas using conductive plastics or conductive composites. U.S. Pat. No. 4,633,265 to Wheeler teaches an omni-directional antenna formed of plural dipoles extending from a common center and capable of use for low frequency and high frequency ranges. U.S. Pat. No 4,143,337 to Salvat et al teaches an omni-directional antenna that has a diagram that is capable of directivity in elevation changes. U.S. Pat. No 5,121,129 to Lee et al teaches an EHF omni-directional antenna. U.S. Pat. 5,534,880 to Button et al teaches a stacked biconical omni directional antenna. U.S. Patent Publication US 2003/0184490 A1 to Raiman et al teaches a sectorized omni-directional antenna.

SUMMARY OF THE INVENTION

A principal object of the present invention is to provide an effective omni-directional antenna device.

A further object of the present invention is to provide a method to form an omni-directional antenna device.

A further object of the present invention is to provide an omni-directional antenna device molded of conductive loaded resin-based materials.

A yet further object of the present invention is to provide an omni-directional antenna device molded of conductive loaded resin-based material where the characteristics can be altered or the visual characteristics can be altered by forming a metal layer over the conductive loaded resin-based material.

A yet further object of the present invention is to provide methods to fabricate an omni-directional antenna device from a conductive loaded resin-based material incorporating various forms of the material.

A yet further object of the present invention is to provide a method to fabricate an omni-directional antenna device from a conductive loaded resin-based material where the material is in the form of a fabric.

A yet further object of the present invention is to provide an omni-directional antenna device capable of monopole, dipole, planar, or other configurations.

A yet further object of the present invention is to provide an omni-directional antenna device that is easily integrated into an electronic appliance such as a camera, cell phone, GPS system, and the like.

In accordance with the objects of this invention, an antenna device is achieved. The antenna device comprises a first hemispherical shaped lobe and a second hemispherical shaped lobe. The first and second hemispherical shaped lobes intersect at a central axis. The first and second hemispherical shaped lobes comprise a conductive loaded, resin-based material comprising conductive materials in a base resin host.

Also in accordance with the objects of this invention, an antenna device is achieved. The antenna device comprises a first hemispherical shaped lobe and a second hemispherical shaped lobe. The first and second hemispherical shaped lobes intersect at a central axis. The first and second hemispherical shaped lobes comprise a conductive loaded, resin-based material comprising conductive materials in a base resin host. The percent by weight of the conductive materials is between about 20% and about 50% of the total weight of the conductive loaded resin-based material.

Also in accordance with the objects of this invention, a method to form an antenna device is achieved. The method comprises providing a conductive loaded, resin-based material comprising conductive materials in a resin-based host. The conductive loaded, resin-based material is molded into the antenna device.

BRIEF DESCRIPTION OF THE DRAWINGS

In the accompanying drawings forming a material part of this description, there is shown.

DESCRIPTION OF THE PREFERRED EMBODIMENTS

Figure 1A:
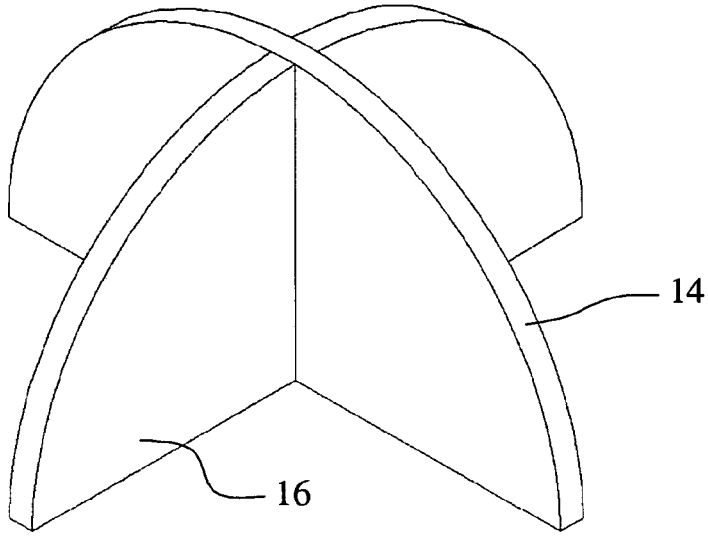
FIGS. 1*a*, 1*b*, and 1*c* illustrate a first preferred embodiment of the present invention showing an omni-directional antenna device comprising a conductive loaded resin-based material.

This invention relates to antennas molded of conductive loaded resin-based materials comprising micron conductive powders, micron conductive fibers, or a combination thereof, homogenized within a base resin when molded.

The conductive loaded resin-based materials of the invention are base resins loaded with conductive materials, which then makes any base resin a conductor rather than an insulator. The resins provide the structural integrity to the molded part. The micron conductive fibers, micron conductive powders, or a combination thereof, are homogenized within the resin during the molding process, providing the electrical continuity.

The conductive loaded resin-based materials can be molded, extruded or the like to provide almost any desired shape or size. The molded conductive loaded resin-based materials can also be cut, stamped, or vacuumed formed from an injection molded or extruded sheet or bar stock, over-molded, laminated, milled or the like to provide the desired shape and size. The thermal or electrical conductivity characteristics of antennas fabricated using conductive loaded resin-based materials depend on the composition of the conductive loaded resin-based materials, of which the loading or doping parameters can be adjusted, to aid in achieving the desired structural, electrical or other physical characteristics of the material. The selected materials used to fabricate the antenna devices are homogenized together using molding techniques and or methods such as injection molding, over-molding, insert molding, thermo-set, protrusion, extrusion or the like. Characteristics related to 2D, 3D, 4D, and 5D designs, molding and electrical characteristics, include the physical and electrical advantages that can be achieved during the molding process of the actual parts and the polymer physics associated within the conductive networks within the molded part(s) or formed material(s).

The use of conductive loaded resin-based materials in the fabrication of antenna devices significantly lowers the cost of materials and the design and manufacturing processes used to hold ease of close tolerances, by forming these materials into desired shapes and sizes. The antenna devices can be manufactured into infinite shapes and sizes using conventional forming methods such as injection molding, over-molding, or extrusion or the like. The conductive loaded resin-based materials, when molded, typically but not exclusively produce a desirable usable range of resistivity from between about 5 and 25 ohms per square, but other resistivities can be achieved by varying the doping parameters and/or resin selection(s).

The conductive loaded resin-based materials comprise micron conductive powders, micron conductive fibers, or any combination thereof, which are homogenized together within the base resin, during the molding process, yielding an easy to produce low cost, electrically conductive, close tolerance manufactured part or circuit. The micron conductive powders can be of carbons, graphites, amines or the like, and/or of metal powders such as nickel, copper, silver, or plated or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment. The micron conductive fibers can be nickel plated carbon fiber, stainless steel fiber, copper fiber, silver fiber, or the like, or combinations thereof. The structural material is a material such as any polymer resin. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material loaded with micron conductive powders, micron conductive fibers, or in combination thereof can be molded, using conventional molding methods such as injection molding or over-molding, or extrusion to create desired shapes and sizes. The molded conductive loaded resin-based materials can also be stamped, cut or milled as desired to form create the desired shape form factor(s) of the antennas. The doping composition and directionality associated with the micron conductors within the loaded base resins can affect the electrical and structural characteristics of the antenna devices and can be precisely controlled by mold designs, gating and or protrusion design(s) and or during the molding process itself. In addition, the resin base can be selected to obtain the desired thermal characteristics such as very high melting point or specific thermal conductivity.

A resin-based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or solid material(s), which when discretely designed in fiber content(s), orientation(s) and shape(s), will produce a very highly conductive flexible cloth-like material. Such a cloth-like material could also be used in forming antenna devices that could be embedded in a person's clothing as well as other resin materials such as rubber(s) or plastic(s). When using conductive fibers as a webbed conductor as part of a laminate or cloth-like material, the fibers may have diameters of between about 3 and 12 microns, typically between about 8 and 12 microns or in the range of about 10 microns, with length(s) that can be seamless or overlapping.

The conductive loaded resin-based material of the present invention can be made resistant to corrosion and/or metal electrolysis by selecting micron conductive fiber and/or micron conductive powder and base resin that are resistant to corrosion and/or metal electrolysis. For example, if a corrosion/electrolysis resistant base resin is combined with stainless steel fiber and carbon fiber/powder, then a corrosion and/or metal electrolysis resistant conductive loaded resin-based material is achieved. Another additional and important feature of the present invention is that the conductive loaded resin-based material of the present invention may be made flame retardant. Selection of a flame-retardant (FR) base resin material allows the resulting product to exhibit flame retardant capability. This is especially important in antenna device applications as described herein.

The homogeneous mixing of micron conductive fiber and/or micron conductive powder and base resin described in the present invention may also be described as doping. That is, the homogeneous mixing converts the typically non-conductive base resin material into a conductive material. This process is analogous to the doping process whereby a semiconductor material, such as silicon, can be converted into a conductive material through the introduction of donor/acceptor ions as is well known in the art of semiconductor devices. Therefore, the present invention uses the term doping to mean converting a typically non-conductive base resin material into a conductive material through the homogeneous mixing of micron conductive fiber and/or micron conductive powder into a base resin.

As an additional and important feature of the present invention, the molded conductor loaded resin-based material exhibits excellent thermal dissipation characteristics. Therefore, antenna devices manufactured from the molded conductor loaded resin-based material can provide added thermal dissipation capabilities to the application. For example, heat can be dissipated from electrical devices physically and/or electrically connected to an antenna device of the present invention.

As a significant advantage of the present invention, antenna devices constructed of the conductive loaded resin-based material can be easily interfaced to an electrical circuit or to ground. In one embodiment, a wire can be attached to a conductive loaded resin-based antenna device via a screw that is fastened to the antenna device. For example, a simple sheet-metal type, self tapping screw can, when fastened to the material, achieve excellent electrical connectivity via the conductive matrix of the conductive loaded resin-based material. To facilitate this approach a boss may be molded into the conductive loaded resin-based material to accommodate such a screw. Alternatively, if a solderable screw material, such as copper, is used, then a wire can be soldered to the screw that is embedded into the conductive loaded resin-based material. In another embodiment, the conductive loaded resin-based material is partly or completely plated with a metal layer. The metal layer forms excellent electrical conductivity with the conductive matrix. A connection of this metal layer to another circuit or to ground is then made. For example, if the metal layer is solderable, then a soldered connection may be made between the antenna device and a circuit wire or a grounding wire.

Figure 1B:
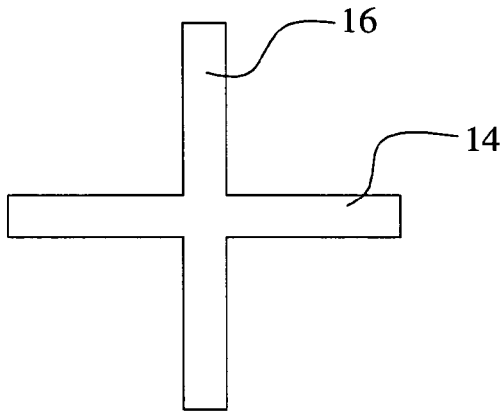
Figure 1C:
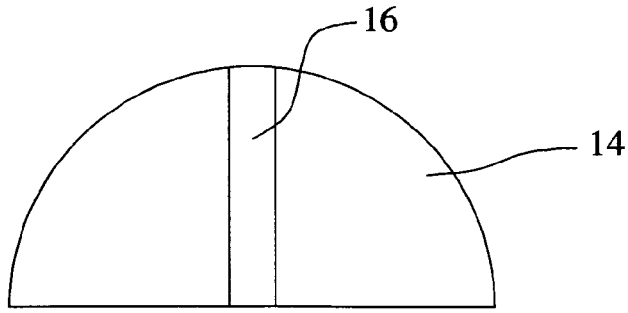

Referring now to FIGS. 1*a*, 1*b*, and 1*c*, a first preferred embodiment of the present invention is illustrated. Several important features of the present invention are shown and discussed below. Referring in particular to FIG. 1*a*, an omni-directional antenna device 10 comprising a conductive loaded resin-based material is shown in isometric view. FIG. 1*b* illustrates the antenna device 10 in top view. FIG. 1*c* illustrates the antenna device 10 in side view. The antenna device 10 comprises hemispherical lobes 14 and 16 intersecting at a central axis. In the most preferred embodiment, two lobes 14 and 16 are formed that intersect at a 90°. Alternatively, more than two lobes may be formed intersecting at symmetric angles about the axis. For example, according to another embodiment, a three lobe antenna, not shown, is formed with each lobe intersecting at 60° with respect to the next lobe.

Each lobe 14 and 16 comprises conductive loaded resin-based material as described in the present invention. The conductive loaded resin-based material is easily formed into the multiple lobe design by molding processes such as injection molding, extrusion, and the like. As a result, a complex and very useful antenna design is achieved using a very simple and manufacturable process. The present invention antenna 10 is far easier to manufacture than metal wire, sheet, or tube alternatives known in the art. Further, the unique and complex shape of the antenna device 10 is preferably formed as a single, homogeneous piece of the conductive loaded resin-based material. The uniquely formulated conductive fiber network and polymer matrix generates an exceptional balance of low resistivity with excellent dielectric and resonance properties for the antenna device. These inherent capabilities of the novel conductive loaded resin-based material are useful for forming the antenna device with a large bandwidth and with an easily tunable frequency response. Further, the conductive loaded resin-based antenna device 10 is less susceptible to near field interference than a comparable metal device.

In the present invention, the novel conductive loaded resin-based material is combined with a unique, hemispherical lobe 14 and 16 arrangement to form a novel and very useful antenna 10. The antenna 10 exhibits an omni-directional field response about the central axis. The center, or resonant, frequency of operation, is easily tuned by scaling the dimensions of the antenna 10. A larger antenna 10 creates a lower center frequency. A smaller antenna 10 creates a higher center frequency. The omni-directional antenna 10 is useful for both transmitting and receiving signals throughout the allocated spectrum range from about 3 KHz to about 300 GHz. An exemplary hemispherical antenna 10 has been fabricated with a tuned operating range of between about 3 GHz and about 5 GHz. The omni-directional antenna 10 of the present invention is useful for a variety of communications applications.

As an optional feature, in one embodiment the conductive loaded resin-based antenna device 10 further comprises a metal layer overlying the antenna surfaces. This metal layer is used to alter the visual, mechanical, and/or electrical properties of the antenna. If used, the metal layer may be formed by plating or by coating. If the method of formation is metal plating, then the resin-based structural material of the conductive loaded, resin-based material is one that can be metal plated. There are many of the polymer resins that can be plated with metal layers. For example, GE Plastics, SUPEC, VALOX, ULTEM, CYCOLAC, UGIKRAL, STYRON, CYCOLOY are a few resin-based materials that can be metal plated. The metal layer may be formed by, for example, electroplating or physical vapor deposition.

Figure 7:
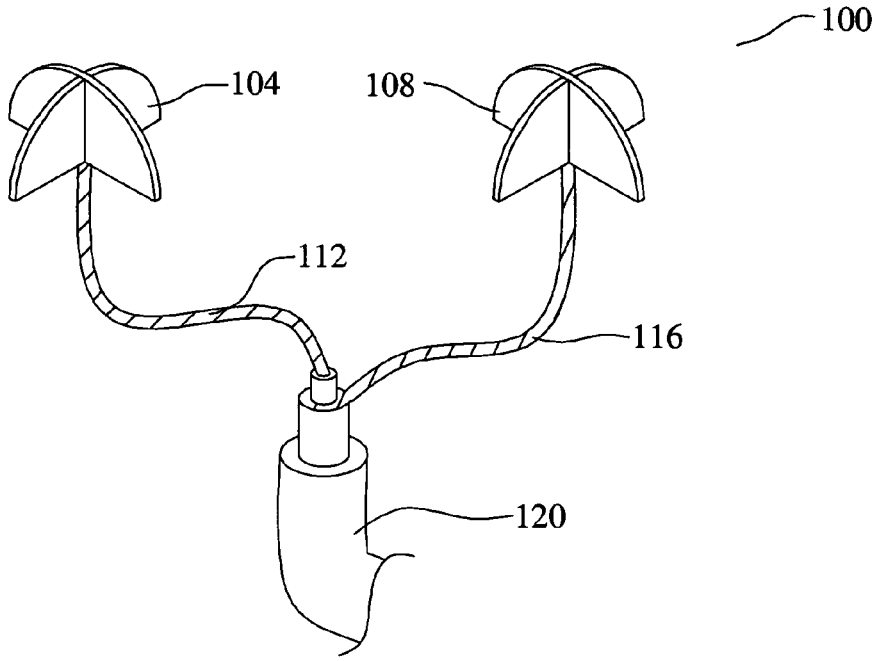
FIG. 7 illustrates a second preferred embodiment of the present invention showing a dipole omni-directional antenna device of the conductive loaded resin-based material.

Referring now to FIG. 7, a second preferred embodiment of the present invention is illustrated. In this embodiment 100, an implementation of a dipole antenna is shown. The radiating antenna device 104 is connected to the center core signal 112 of a coaxial cable 120. The shielding or grounding signal 116 of the coaxial cable 120 is connected to a balancing, or counterpoise, antenna device 108. In this embodiment, both the radiating device 104 and the counterpoise device 108 comprise the novel conductive loaded resin-based, hemispherical antenna design. The conductors 112 and 116 are preferably connected to the center axis of the radiating antenna 104 and the counterpoise antenna, respectively.

If the conductors 112 and 116 are metal, such as metal wire, then the connection to the conductive loaded resin-based antenna devices 104 and 108 is made in any of several ways. In one embodiment, a pin, not shown, is embedded into the conductive loaded resin-based material by insert molding, ultrasonic welding, pressing, or other means. A connection with a metal wire 112 can easily be made to this pin and results in excellent contact to the conductive loaded resin-based antenna device 104. In another embodiment, a hole is formed in to the conductive loaded resin-based material either during the molding process or by a subsequent process step such as drilling, punching, or the like. A pin is placed into the hole and is then ultrasonically welded to form a permanent mechanical and electrical contact.

In yet another embodiment, a pin or even the wire 112 is soldered to the conductive loaded resin-based material. In this case, a hole is formed in the axis of the antenna devices 104 and 108. According to one embodiment, the hole is formed during the molding operation. In another embodiment, the hole is subsequently formed by drilling, stamping, punching, or the like. A solderable layer is then formed in the hole. The solderable layer is preferably formed by metal plating. The conductors 112 and 116 are placed into the hole and then mechanically and electrically bonded by point, wave, or reflow soldering. According to another embodiment, the coaxial central conductor 112 and/or shielding conductor 116 also comprises the conductive loaded resin-based material. In this embodiment, the conductors 112 and 116 are preferably co-molded with the antennas 104 and 108.

Figure 10:
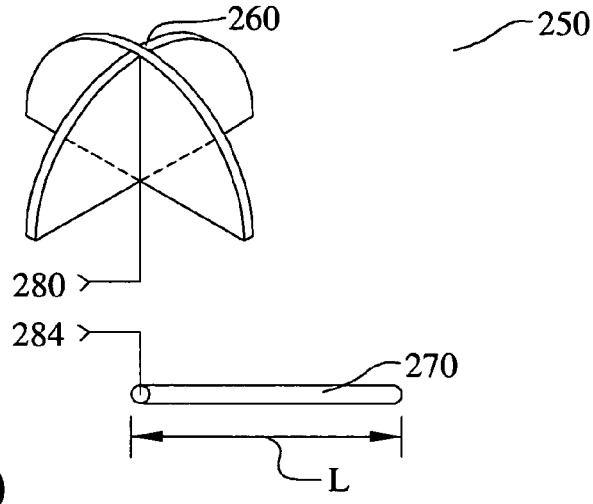
FIG. 10 illustrates a fifth preferred embodiment of the present invention showing a dipole omni-directional antenna device with a conductive line as the counterpoise.

In a fifth embodiment 250, as shown in FIG. 10, the counterpoise device 108 is replaced by a simple conductor 270 having a length, L, that is a multiple of a quarter wavelength of the center, or resonant, frequency of the conductive loaded resin-based radiating antenna device 260. The radiating antenna device 260 axis and one end of the conductor line 270 are connected by the balanced signals 280 and 284. In another embodiment, the conductor line 270 also comprises the conductive loaded resin-based material. In this embodiment, the conductor line 270 is preferably co-molded with the radiating antenna device 260.

Figure 8:
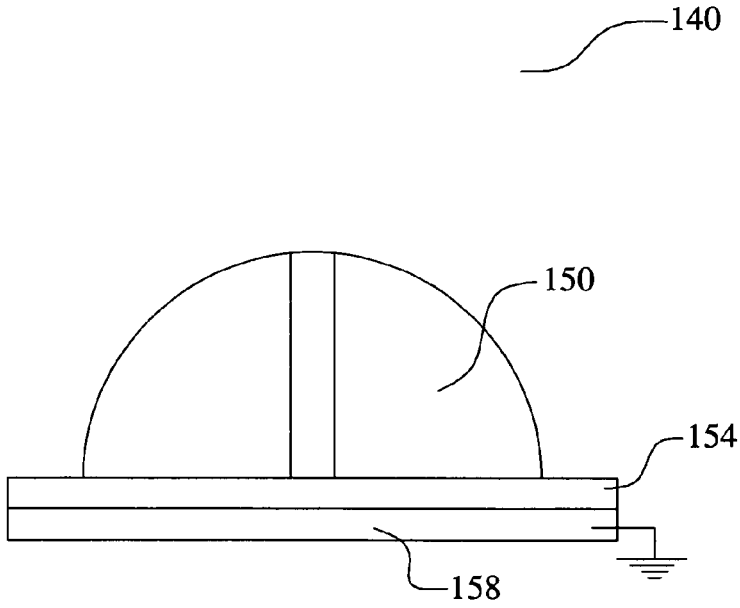
FIG. 8 illustrates a third preferred embodiment of the present invention showing a monopole omni-directional antenna device of the conductive loaded resin-based material.

Referring now to FIG. 8, a third preferred embodiment of the present invention is illustrated. In this embodiment 140, the omni-directional, conductive loaded resin-based radiating antenna 150 is mounted over a conductive ground plane 158. A dielectric layer 154 separates the radiating antenna device 150 from the conductive ground plane 158. The ground plane 158 is preferably in equal balanced proximity to the conductive loaded resin-based radiating antenna 150 of the present invention. The distance between the radiating antenna 150 and the ground plane 150 is critical to determining the center, or resonant, frequency as well to determining as the performance of the antenna. In one embodiment, the conductive ground plane 158 also comprises the conductive loaded resin-based material 158. In another embodiment, the dielectric layer 154 comprises a resin-based material and, more preferably, comprises the same base resin as is used in the conductive loaded resin-based material of the radiating antenna 150. In another embodiment, the conductive loaded resin-based radiating antenna 150 and the ground plane 158 are co-molded.

Figure 9A:
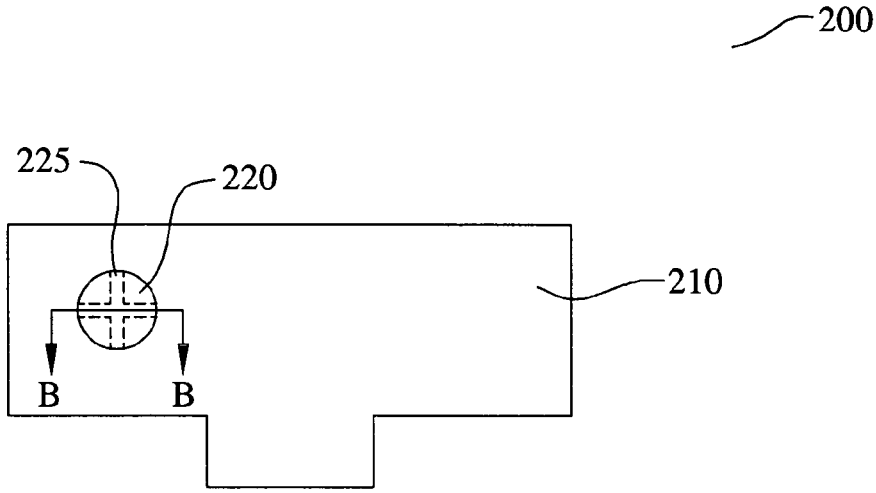
FIGS. 9*a* and 9*b* illustrate a fourth preferred embodiment of the present invention showing an omni-directional antenna device integrated into a camera button.
Figure 9B:
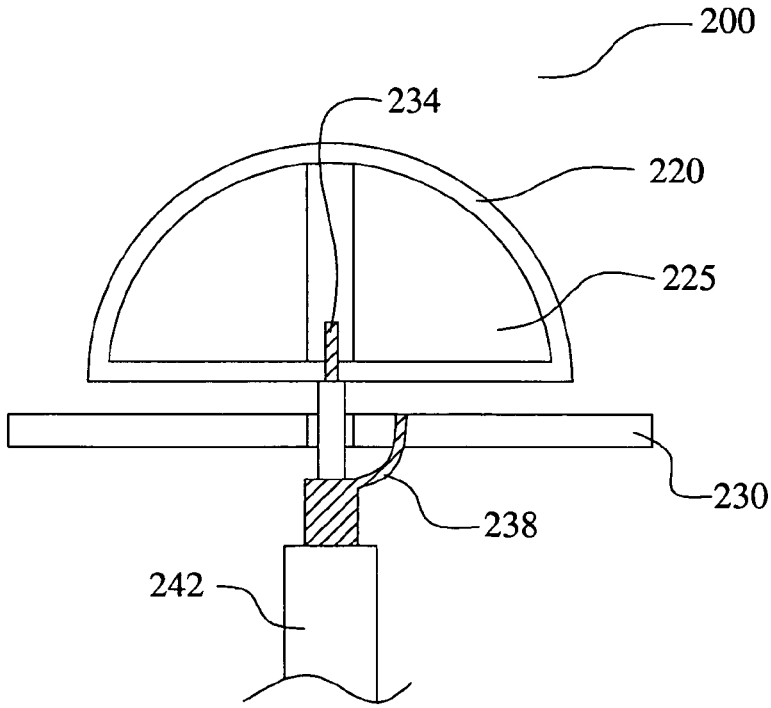

Referring now to FIGS. 9*a* and 9*b*, a fourth preferred embodiment of the present invention is illustrated. In this embodiment 200, a conductive loaded resin-based omni-directional antenna device 225 is integrated into an activation button 220 for a camera device 210. In this exemplary application, the antenna device 225 is configured for upload/download communications with a center, or resonant, frequency determined by the physical size of the antenna 225. An insulating layer 220 is formed over the antenna 225. Preferably, the insulating layer 220 comprises a resin-based material that is formed over the antenna device 225 by molding, coating, or the like. In one embodiment, the antenna 225 is contacted to the circuit by a cable 242. The center wire 234 of the cable contacts the conductive loaded resin-based antenna 225, while the shielding 238, or grounding, of the cable 242 contacts the underlying circuit board 230. Further, the circuit board 230 preferably acts as a ground plane for the antenna 225.

Figure 11A:
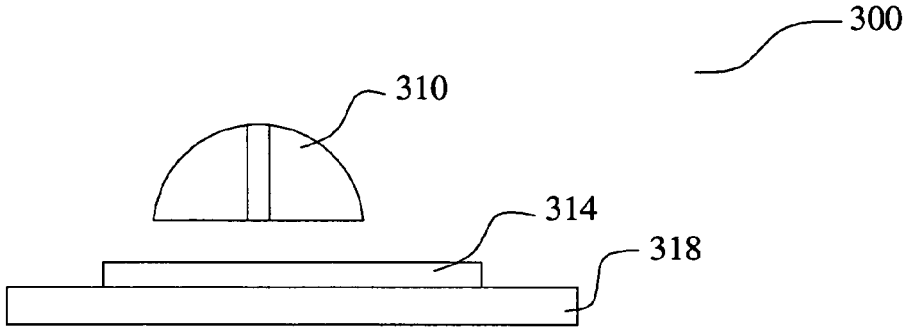
FIGS. 11*a* and 11*b* illustrate a sixth preferred embodiment of the present invention showing an omni-directional antenna with a counterpoise comprising a trace on a circuit board.
Figure 11B:
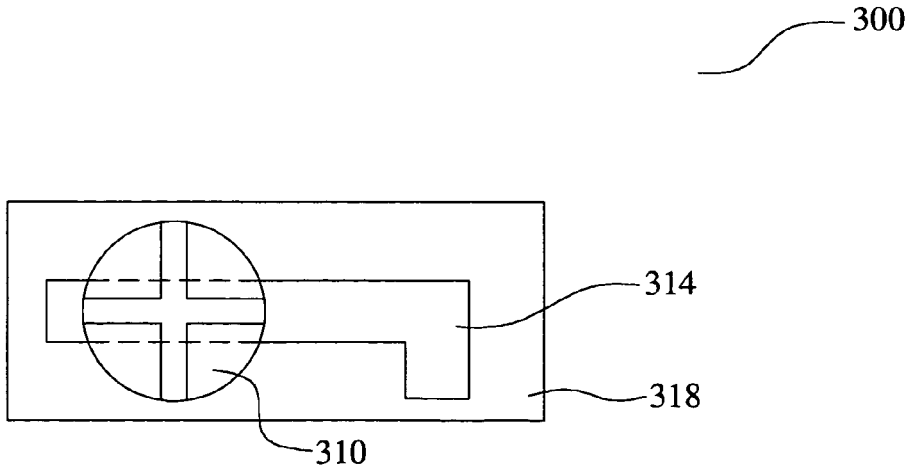

Referring now to FIGS. 11*a* and 11*b*, a sixth preferred embodiment of the present invention is illustrated. In this embodiment 300, the novel spherical shaped antenna 310 overlies a substrate 318. A trace 314 on the substrate 318 acts as the counterpoise for the antenna 310. In one embodiment, the counterpoise trace 314 comprises the conductive loaded resin-based material of the present invention.

Figure 2:
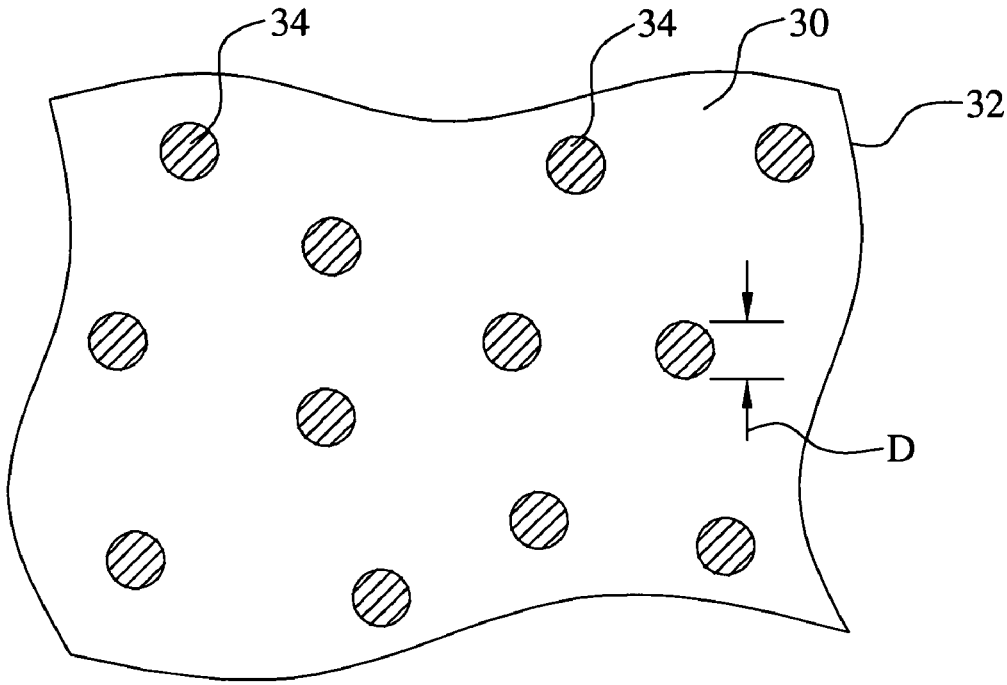
FIG. 2 illustrates a first preferred embodiment of a conductive loaded resin-based material wherein the conductive materials comprise a powder.

The conductive loaded resin-based material of the present invention typically comprises a micron powder(s) of conductor particles and/or in combination of micron fiber(s) homogenized within a base resin host. FIG. 2 shows cross section view of an example of conductor loaded resin-based material 32 having powder of conductor particles 34 in a base resin host 30. In this example the diameter D of the conductor particles 34 in the powder is between about 3 and 12 microns.

Figure 3:
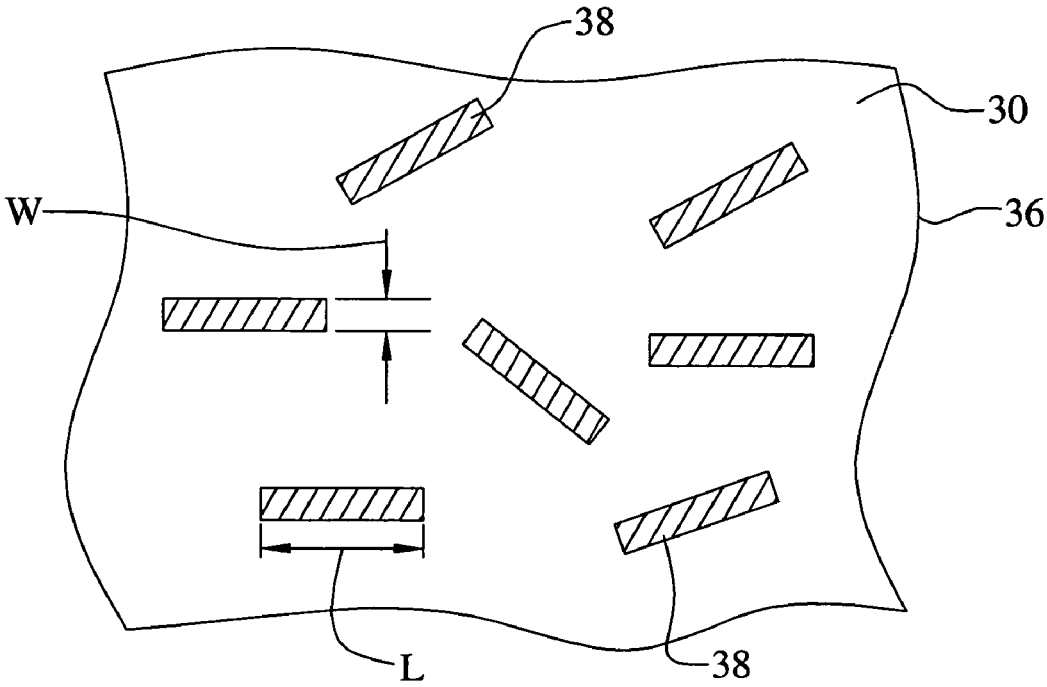
FIG. 3 illustrates a second preferred embodiment of a conductive loaded resin-based material wherein the conductive materials comprise micron conductive fibers.
Figure 4:
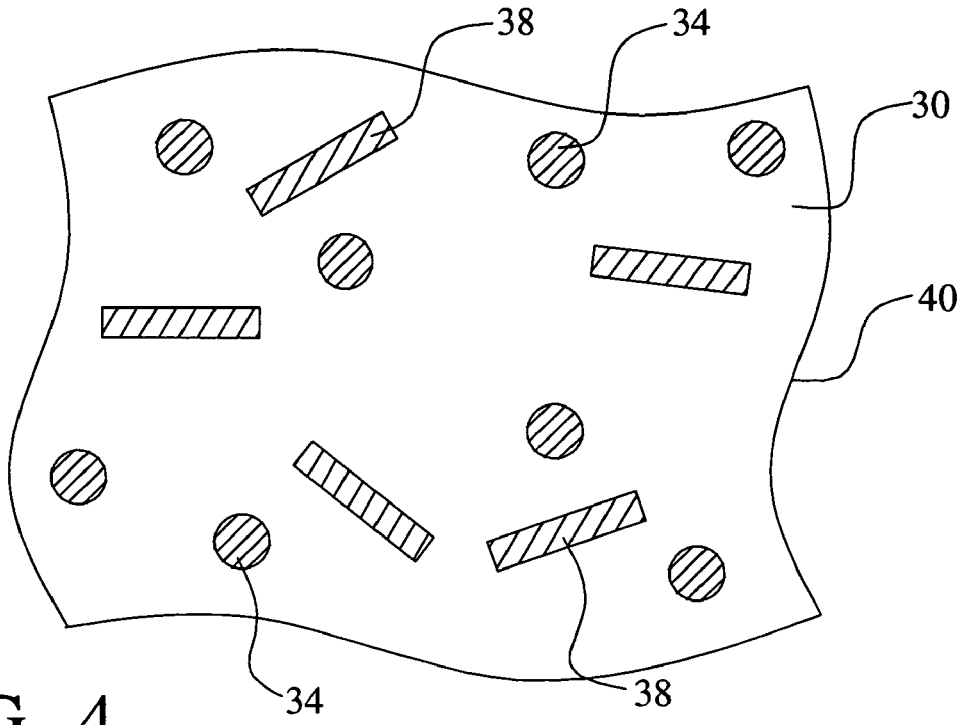
FIG. 4 illustrates a third preferred embodiment of a conductive loaded resin-based material wherein the conductive materials comprise both conductive powder and micron conductive fibers.

FIG. 3 shows a cross section view of an example of conductor loaded resin-based material 36 having conductor fibers 38 in a base resin host 30. The conductor fibers 38 have a diameter of between about 3 and 12 microns, typically in the range of 10 microns or between about 8 and 12 microns, and a length of between about 2 and 14 millimeters. The conductors used for these conductor particles 34 or conductor fibers 38 can be stainless steel, nickel, copper, silver, or other suitable metals or conductive fibers, or combinations thereof. These conductor particles and or fibers are homogenized within a base resin. As previously mentioned, the conductive loaded resin-based materials have a sheet resistance between about 5 and 25 ohms per square, though other values can be achieved by varying the doping parameters and/or resin selection. To realize this sheet resistance the weight of the conductor material comprises between about 20% and about 50% of the total weight of the conductive loaded resin-based material. More preferably, the weight of the conductive material comprises between about 20% and about 40% of the total weight of the conductive loaded resin-based material. More preferably yet, the weight of the conductive material comprises between about 25% and about 35% of the total weight of the conductive loaded resin-based material. Still more preferably yet, the weight of the conductive material comprises about 30% of the total weight of the conductive loaded resin-based material. Stainless Steel Fiber of 8-11 micron in diameter and lengths of 4-6 mm and comprising, by weight, about 30% of the total weight of the conductive loaded resin-based material will produce a very highly conductive parameter, efficient within any EMF spectrum. Referring now to FIG. 4, another preferred embodiment of the present invention is illustrated where the conductive materials comprise a combination of both conductive powders 34 and micron conductive fibers 38 homogenized together within the resin base 30 during a molding process.

Figure 5A:
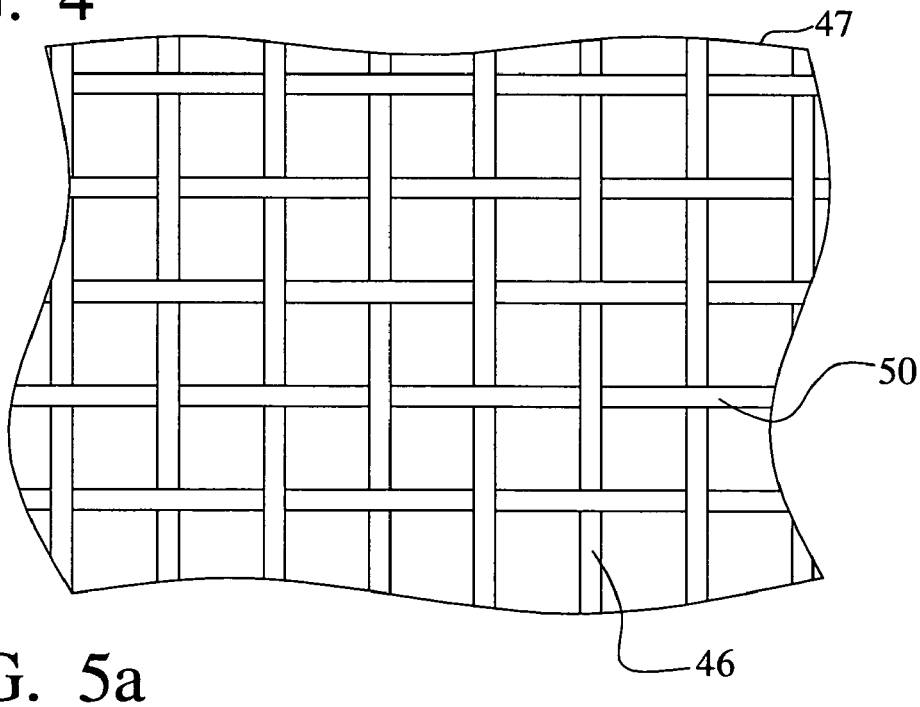
FIGS. 5*a* and 5*b* illustrate a fourth preferred embodiment wherein conductive fabric-like materials are formed from the conductive loaded resin-based material.
Figure 5B:
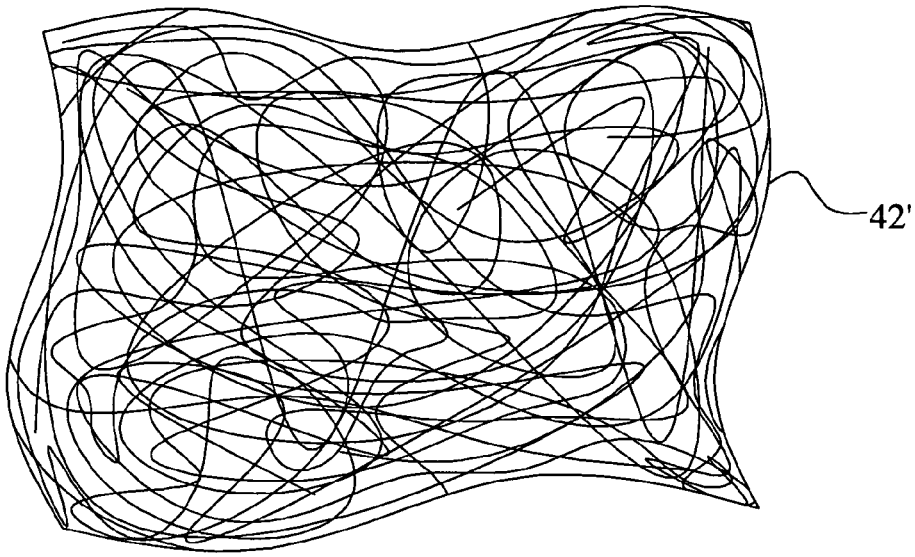

Referring now to FIGS. 5*a* and 5*b*, a preferred composition of the conductive loaded, resin-based material is illustrated. The conductive loaded resin-based material can be formed into fibers or textiles that are then woven or webbed into a conductive fabric. The conductive loaded resin-based material is formed in strands that can be woven as shown. FIG. 5*a* shows a conductive fabric 42 where the fibers are woven together in a two-dimensional weave 46 and 50 of fibers or textiles. FIG. 5*b* shows a conductive fabric 42' where the fibers are formed in a webbed arrangement. In the webbed arrangement, one or more continuous strands of the conductive fiber are nested in a random fashion. The resulting conductive fabrics or textiles 42, see FIG. 5*a*, and 42', see FIG. 5*b*, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 6A:
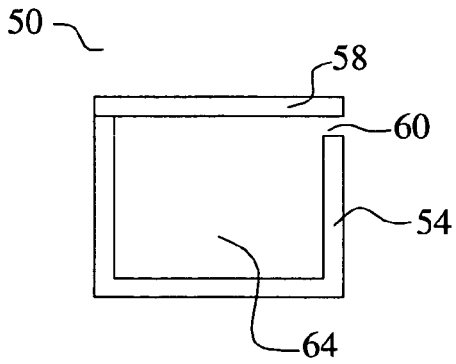
FIGS. 6*a* and 6*b* illustrate, in simplified schematic form, an injection molding apparatus and an extrusion molding apparatus that may be used to mold omni-directional antenna devices of a conductive loaded resin-based material.

Antenna devices formed from conductive loaded resin-based materials can be formed or molded in a number of different ways including injection molding, extrusion or chemically induced molding or forming. FIG. 6*a* shows a simplified schematic diagram of an injection mold showing a lower portion 54 and upper portion 58 of the mold 50. Conductive loaded blended resin-based material is injected into the mold cavity 64 through an injection opening 60 and then the homogenized conductive material cures by thermal reaction. The upper portion 58 and lower portion 54 of the mold are then separated or parted and the antenna devices are removed.

Figure 6B:
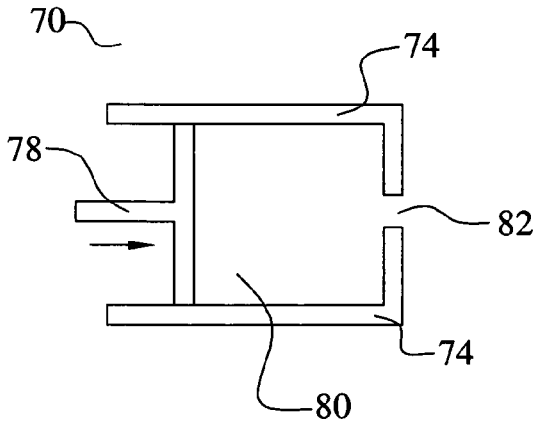

FIG. 6*b* shows a simplified schematic diagram of an extruder 70 for forming antenna devices using extrusion. Conductive loaded resin-based material(s) is placed in the hopper 80 of the extrusion unit 74. A piston, screw, press or other means 78 is then used to force the thermally molten or a chemically induced curing conductive loaded resin-based material through an extrusion opening 82 which shapes the thermally molten curing or chemically induced cured conductive loaded resin-based material to the desired shape. The conductive loaded resin-based material is then fully cured by chemical reaction or thermal reaction to a hardened or pliable state and is ready for use. Thermoplastic or thermosetting resin-based materials and associated processes may be used in molding the conductive loaded resin-based articles of the present invention.

The advantages of the present invention may now be summarized. An effective omni-directional antenna device is achieved. A method to form the omni-directional antenna device is achieved. The omni-directional antenna device is molded of conductive loaded resin-based materials. The characteristics of the omni-directional antenna device can be altered or the visual characteristics can be altered by forming a metal layer over the conductive loaded resin-based material. The methods to fabricate an omni-directional antenna device from a conductive loaded resin-based material incorporate various forms of the material. A method to fabricate an omni-directional antenna device from a conductive loaded resin-based material where the material is in the form of a fabric is achieved. The omni-directional antenna device is capable of monopole, dipole, planar, and other configurations. The omni-directional antenna device is easily integrated into an electronic appliance such as a camera, cell phone, GPS system, and the like.

As shown in the preferred embodiments, the novel methods and devices of the present invention provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. A method to form an antenna device, said method comprising:

providing a conductive loaded, resin-based material comprising conductive materials in a resin-based host wherein the percent by weight of said conductive materials is between 20% and 40% of the total weight of said conductive loaded resin-based material; and molding said conductive loaded, resin-based material into said antenna device; and embedding a signal line into said antenna device.

2. The method according to claim 1 wherein said conductive materials comprise micron conductive fiber.

3. The method according to claim 2 wherein said micron conductive fiber is nickel plated carbon fiber, or stainless steel fiber, or copper fiber, or silver fiber or combinations thereof.

4. The method according to claim 2 wherein said micron conductive fiber has a diameter of between about 3 μm and about 12 μm and a length of between about 2 mm and about 14 mm.

5. The method according to claim 4 wherein said micron conductive fiber is nickel plated carbon fiber, or stainless steel fiber, or copper fiber, or silver fiber or combinations thereof.

6. The method according to claim 1 wherein said conductive materials comprise conductive powder.

7. The method according to claim 1 wherein said conductive materials comprise a combination of conductive powder and conductive fiber.

8. The method according to claim 1 wherein said molding comprises:

injecting said conductive loaded, resin-based material into a mold;

curing said conductive loaded, resin-based material; and removing said antenna device from said mold.

9. The method according to claim 1 wherein said molding comprises:

loading said conductive loaded, resin-based material into a chamber;

extruding said conductive loaded, resin-based material out of said chamber through a shaping outlet; and curing said conductive loaded, resin-based material to form said antenna device.

10. The method according to claim 1 further comprising subsequent mechanical processing of said molded conductive loaded, resin-based material.

11. The method according to claim 1 further comprising overlying a layer of metal on said molded conductive loaded, resin-based material.

12. The method according to claim 1 wherein said step of embedding a signal line comprises:

placing said signal line into a molding die; and overmolding said antenna device onto said signal line during said step of molding said antenna device.

13. The method according to claim 1 wherein said step of embedding a signal line comprises pressing said signal line into said antenna device.

14. The method according to claim 1 wherein said step of embedding a signal line comprises:

making a hole in said antenna device;

inserting said signal line into said hole; and ultrasonically welding said signal line to said antenna device.

15. A method to form an antenna device, said method comprising:

providing a conductive loaded, resin-based material comprising micron conductive fiber in a resin-based host wherein said micron conductive fiber has a diameter of between 3 μm and about 12 μm and a length of between 2 mm and about 14 mm; and molding said conductive loaded, resin-based material into said antenna device; and embedding a signal line into said antenna device.

16. The method according to claim 10 wherein said micron conductive fiber is nickel plated carbon fiber, or stainless steel fiber, or copper fiber, or silver fiber or combinations thereof.

17. The method according to claim 10 further comprising conductive powder.

18. The method according to claim 10 wherein said molding comprises:

injecting said conductive loaded, resin-based material into a mold;

curing said conductive loaded, resin-based material; and removing said antenna device from said mold.

19. The method according to claim 10 wherein said molding comprises:

loading said conductive loaded, resin-based material into a chamber;

extruding said conductive loaded, resin-based material out of said chamber through a shaping outlet; and curing said conductive loaded, resin-based material to form said antenna device.

20. The method according to claim 10 further comprising subsequent mechanical processing of said molded conductive loaded, resin-based material.

21. The method according to claim 10 further comprising overlying a layer of metal on said molded conductive loaded, resin-based material.

22. The method according to claim 15 wherein said step of embedding a signal line comprises:

placing said signal line into a molding die; and overmolding said antenna device onto said signal line during said step of molding said antenna device.

23. The method according to claim 15 wherein said step of embedding a signal line comprises pressing said signal line into said antenna device.

24. The method according to claim 15 wherein said step of embedding a signal line comprises:

making a hole in said antenna device;

inserting said signal line into said hole; and ultrasonically welding said signal line to said antenna device.

* * * * *